US005625912A

United States Patent [19]

McCain et al.

[11] Patent Number: 5,625,912

[45] Date of Patent: May 6, 1997

[54] MATTRESS COVERINGS

[75] Inventors: Ricky A. McCain; John W. Whitley, both of Monroe, N.C.

[73] Assignee: Perfect Fit Industries, Inc., Monroe, N.C.

[21] Appl. No.: 673,899

[22] Filed: Jul. 1, 1996

Related U.S. Application Data

[63] Continuation-in-part of Ser. No. 269,487, Jul. 1, 1994, Pat. No. 5,530,979, which is a continuation-in-part of Ser. No. 45,643, Apr. 9, 1993, Pat. No. 5,325,555.

[51] Int. Cl.[6] ..... A47G 9/04; A47G 9/02

[52] U.S. Cl. ..... 5/497; 5/499; 5/500; 5/502

[58] Field of Search ..... 5/497, 499, 495, 5/496, 498, 482, 500, 502

[56] References Cited

U.S. PATENT DOCUMENTS

| | | | |
|---|---|---|---|
| 2,245,779 | 6/1941 | Heil | 5/499 |
| 2,528,313 | 10/1950 | Kessler . | |
| 2,569,627 | 10/1951 | Black | 5/497 |
| 2,856,615 | 10/1958 | Cirocco . | |
| 2,942,280 | 6/1960 | May, Jr. | 5/497 |
| 3,020,566 | 2/1962 | Anderson et al. | 5/497 |
| 4,042,986 | 8/1977 | Goodman et al. . | |
| 4,651,370 | 3/1987 | Vitale | 5/497 |
| 4,672,702 | 6/1987 | Isham | 5/497 |
| 4,703,530 | 11/1987 | Gusman | 5/497 |
| 4,757,564 | 7/1988 | Goodale . | |
| 4,962,546 | 10/1990 | Vitale | 5/497 |
| 4,980,941 | 1/1991 | Johnson, III | 5/497 |
| 4,985,953 | 1/1991 | Seago | 5/497 |
| 5,127,115 | 7/1992 | Williams et al. | 5/497 |
| 5,325,555 | 7/1994 | Whitley | 5/500 |
| 5,530,979 | 7/1996 | Whitley | 5/500 |

FOREIGN PATENT DOCUMENTS

| | | | |
|---|---|---|---|
| 0425466 | 5/1991 | European Pat. Off. | 5/497 |

*Primary Examiner*—Alexander Grosz

*Attorney, Agent, or Firm*—Panitch Schwarze Jacobs & Nadel, P.C.

[57] ABSTRACT

A mattress covering in the form of a fitted mattress pad or fitted sheet has a top portion, an inelastic side skirt extending perpendicularly from the top portion, an inelastic underskirt extending from the side skirt, a first elastic cord attached to the inelastic underskirt at its outer periphery remote from the top portion. At least a second, separate elastic cord attached to the covering at some place between the top portion and the first elastic cord. The top portion is dimensioned to fit a standard size mattress and the side skirt and underskirt are dimensioned to fit a range of mattress heights. The side skirt can be made of the same quilted or sheet material as the top portion for an attractive appearance, or it can be made of other material, such as a single layer of a non-quilted inelastic fabric to reduce cost. The inelastic underskirt can be made of the same material as that of the side skirt or, more typically, a single layer of an even less expensive material.

13 Claims, 7 Drawing Sheets

MATTRESS COVERINGS

RELATED APPLICATION

The present application is a continuation-in-part of patent application Ser. No. 08/269,487 filed Jul. 1, 1994, now U.S. Pat. No. 5,530,979, which is a continuation-in-part of patent application Ser. No. 08/045,643 filed Apr. 9, 1993, now U.S. Pat. No. 5,325,555.

FIELD OF THE INVENTION

The present invention relates generally to mattress coverings, such as mattress pads and sheets, and more particularly to a new and improved fitted mattress covering capable of practical and effective use with mattresses of a standard top surface sizes and a range of heights.

BACKGROUND OF THE INVENTION

Fitted mattress pads and sheets are commonly used and are available in various forms. Probably the simplest form of fitted sheet or mattress pad is one having the top and sides formed of the same material that is cut and sewn to fit a standard size or range of sizes of mattresses and has an elastic band or cord attached around the lower periphery to draw the lowermost edge of the covering under the mattress to retain the covering in fitted condition. The corners of this type of covering are either entirely straight in the vertical direction or curved inward to facilitate their movement under mattresses of varying heights. Such coverings have the advantage of ease of manufacture and the desirable appearance of the sides being of the same material as the top, e.g. quilted sides and top. They have the disadvantage, however, of utilizing at most only a single elastic band along their lowermost periphery to retain an otherwise inelastic covering on mattresses of varying heights. They have a further disadvantage of being expensive to make if the top panel material, e.g., the quilted material, extends down along the sides of the pad sufficiently to provide enough material to extend at least the full height of mattresses of the greatest thickness (i.e., height), so that the covering can be sold for use with mattresses of varying thicknesses (heights).

Another form of covering is a mattress pad that has a quilted top and an elastic side skirt that further extends downwardly sufficiently to cover the sides and extends under mattresses of varying heights within a standard range for retention of the covering on the mattress. An elastic band or cord typically is attached to the lowermost periphery to facilitate retention of the covering on the mattress. Normally, such coverings are made with corners that are curved in the vertical direction to facilitate fitting under mattresses of varying height. Such pads use skirts formed by joined together elastic and inelastic layers. Other pads use single-layer skirts formed from single panels of inelastic material, which are elasticized by being stitched and gathered with multiple parallel rows of elastic threads sewn into the otherwise inelastic skirt panel, or are elasticized by being stitched or woven with elastic threads. Such mattress coverings have the disadvantage of a different and less desirable appearance of the sides due to the use of the different material rather than being able to use the same material, such as the sheet or quilted material of the top.

SUMMARY OF THE INVENTION

The invention is a mattress covering adapted for fitted disposition over the top, sides, ends and corners of mattresses of standard top surface sizes comprising an inelastic, generally rectangular top portion having an outer periphery dimensioned to at least substantially cover the top surface of mattresses of at least one predetermined standard top surface size; an inelastic side skirt extending transversely from the outer periphery of the generally rectangular top portion around the entire outer periphery of the top portion; a separate inelastic panel extending away from a periphery of the side skirt remote from the top portion and entirely around the side skirt periphery; a first elastic cord; means for securing the first elastic cord to the inelastic panel at a periphery of the inelastic panel remote from the side skirt; a second elastic cord; and means for securing the second elastic cord with one of the side skirt and the inelastic panel at a location between the outer periphery of the top portion and the periphery of the inelastic panel.

BRIEF DESCRIPTION OF THE DRAWINGS

The foregoing summary, as well as the following detailed description of preferred embodiments of the invention will be better understood when in conjunction with the appended drawings. For the purpose of illustrating the invention, there is shown diagrammatically in the drawings, embodiments which are presently preferred as well as other alternate embodiments. It should be understood, however, that the invention is not limited to the specific methods and instrumentalities disclosed. In the drawings.

DETAILED DESCRIPTION OF THE PREFERRED EMBODIMENTS

Figure 1:
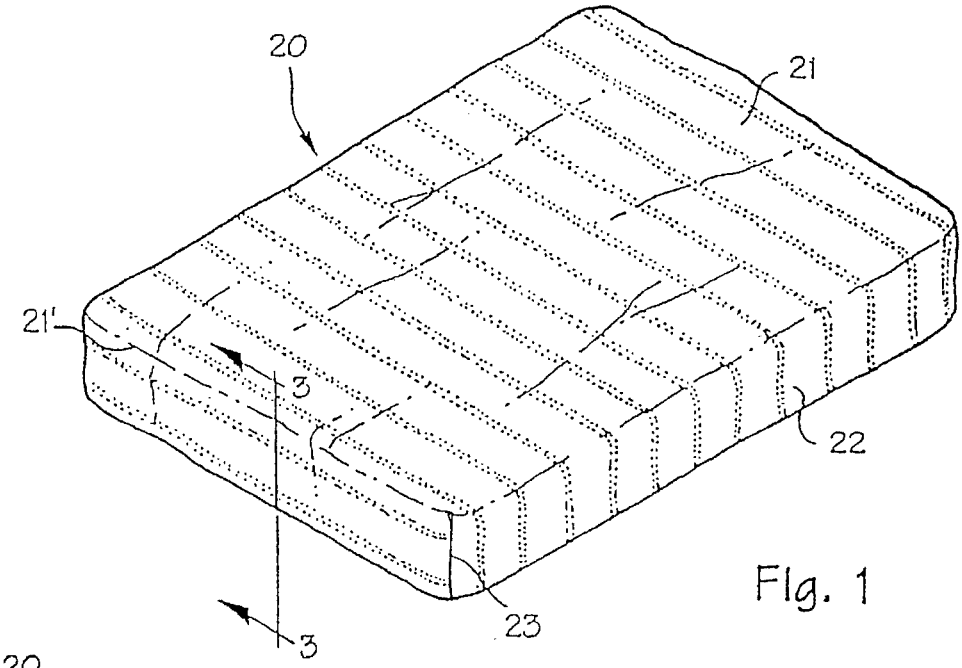
FIG. 1 is a perspective view of a mattress on which one form of the preferred embodiment of the mattress covering of the present invention is fitted.

Initially, related U.S. Pat. Nos. 5,325,555 and 5,530,979 are incorporated herein by reference in their entireties. One of the preferred embodiments of the mattress covering of the present invention is illustrated in FIGS. 1–7. In this form, the mattress covering is a mattress pad 20 adapted for fitted disposition over the top, side, ends and corners of mattresses of predetermined standard top surface sizes. Pad 20 has an inelastic, generally rectangular and planar top panel portion 21 of conventional, preferably quilted pad material. Preferably an inelastic side skirt 22 is formed of the same material integrally with the top portion 21. The side skirt 22 extends entirely around and transversely away from the outer periphery 21' of top portion 21. Side skirt 22 preferably is formed with corners 23 that extend transversely and preferably at least generally perpendicularly and straight from the "corners" of the outer periphery 21' of the generally rectangular top portion 21 to fit closely over the corners, sides and ends of a mattress. Side skirt 22 has a "lower" periphery 22', which is on a side of the side skirt 22 remote from the top portion 21. Secured to and extending around and away from the lower periphery 22' of the side skirt 22 is a separate inelastic panel defining an inelastic underskirt 24. In the illustrated embodiments, the inelastic underskirt 24 is formed from a single layer of inelastic textile fabric, which may be of natural fiber, a synthetic material or a blend and woven or non-woven.

To facilitate the retention of the mattress pad 20 on the mattress, at least one elastic cord 27 of a type conventionally used in bedding, is secured to a periphery 24' of the inelastic underskirt 24, remote from side skirt 22, at a "free" edge of the inelastic underskirt, in a conventional way such as by being stitched with thread directly to the underskirt 24 or by being stitched or otherwise located in a fold 28 or sleeve formed in the underskirt 24 at the periphery 24' of the underskirt 24. The elastic cord 27 extends at least partially and preferably essentially entirely around the outer periphery 24' of underskirt 24. In previous embodiments of the invention, the panel or panels forming the underskirt have been elasticized by the adhesion of an elastomer panel to inelastic panels or the addition of elastic thread stitched along the inelastic panel. While it is possible to leave the inelastic underskirt and side skirt devoid of any elastic support, to further facilitate retention of the mattress pad 20 on the mattress, at least a second elastic cord 26 of a type conventionally used in bedding preferably is secured to the pad 20 between the outer periphery 21' of the top panel portion 21 and the periphery 24' of the inelastic underskirt 24, preferably along the periphery 22' of the side skirt 22, in a conventional fashion.

Figure 3:
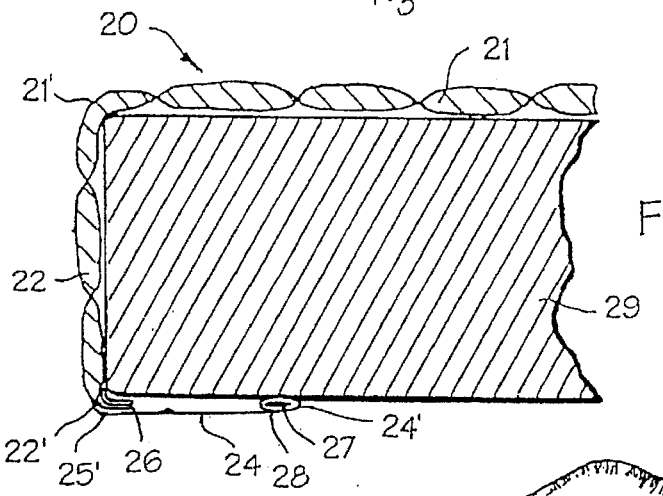
FIG. 3 is a partial vertical sectional view taken along line 3—3 of FIG. 1.
Figure 2:
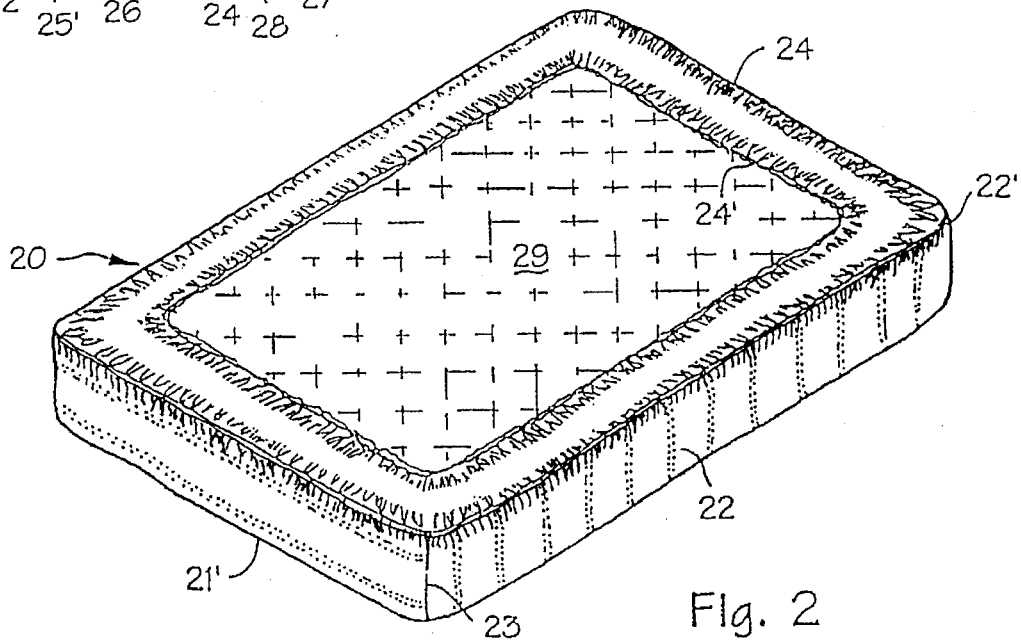
FIG. 2 is a perspective view of the mattress and covering of FIG. 1 as viewed looking toward the bottom of the mattress and covering.

Despite the provision of an inelastic side skirt 22 with an inelastic underskirt 24, the mattress pad 20 is capable of practical and effective use on standard top size mattresses within a relatively wide range of heights by the provision of at least the two elastic cords 26 and 27. As illustrated in FIGS. 1, 2 and 3, the mattress pad 20 is fitted on a mattress 29 of at least one predetermined standard top surface size (e.g. twin, full, queen, king, western or California king, etc.). The outer periphery 21' of the top portion 21 of the mattress pad 20 is dimensioned to cover the top surface of mattresses of a standard top surface size by having length and width dimensions at least substantially if not essentially the same as the predetermined standard length and width top surface dimensions of the standard size mattress on which the pad is to be used. Preferably, the side skirt 22 has a width dimension between the top portion 21 and inelastic underskirt 24 (i.e., extends downwardly from the top portion 21 an extent) at least equal to a width dimension of the underskirt 24 and preferably substantially the same as a height of an intermediate height mattress 29 within a predetermined standard range of heights. For example, in the United States, standard mattress heights currently range from less than about five inches to as many as about fourteen or more inches. An "intermediate" height of that standard range currently would be between about eight and about eleven inches, for example. Thus, side skirt 22 preferably but not necessarily has a height of between about eight inches and about eleven inches, for example, about nine and one half inches. Such a side skirt 22 could have a width dimension between outer peripheries 21' and 22' of the top portion and the side skirt at least a great as and preferably between about one and four times as great as the width of the inelastic underskirt 24 between outer peripheries 22' and 24' of the side skirt and underskirt, respectively.

As can be seen in the drawings, the top and the sides of all mattress pad are formed with the same attractive, preferably quilted material, which preferably extends down only to the bottom of the side walls of the intermediate height mattress 29, with the underskirt 24 being hidden under the mattress. This reduces the amount of quilted material that must be used in making the mattress pad 20 of this particular size and provides an underskirt 24 of sufficient width to effectively draw the mattress pad 20 into fitted disposition with the mattress 29 and the straight corners 23 fitting neatly at the corners of the mattress 29.

Figure 4:
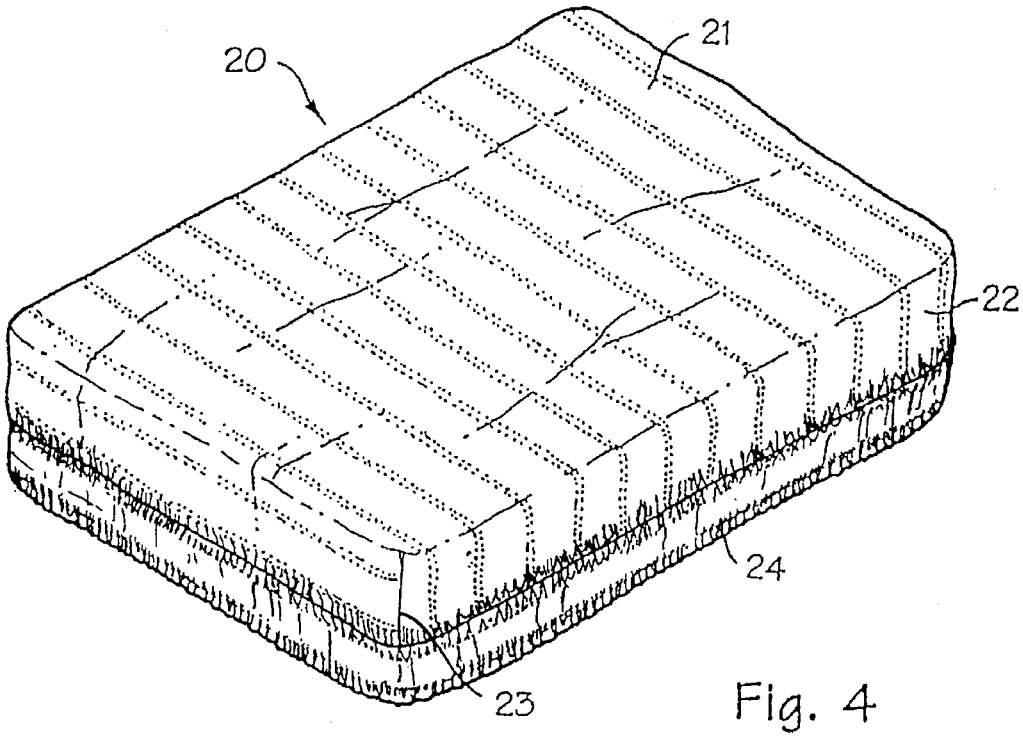
FIG. 4 is a perspective view showing the mattress covering of FIG. 1 fitted on a mattress of a higher height than the mattress of FIG. 1.
Figure 5:
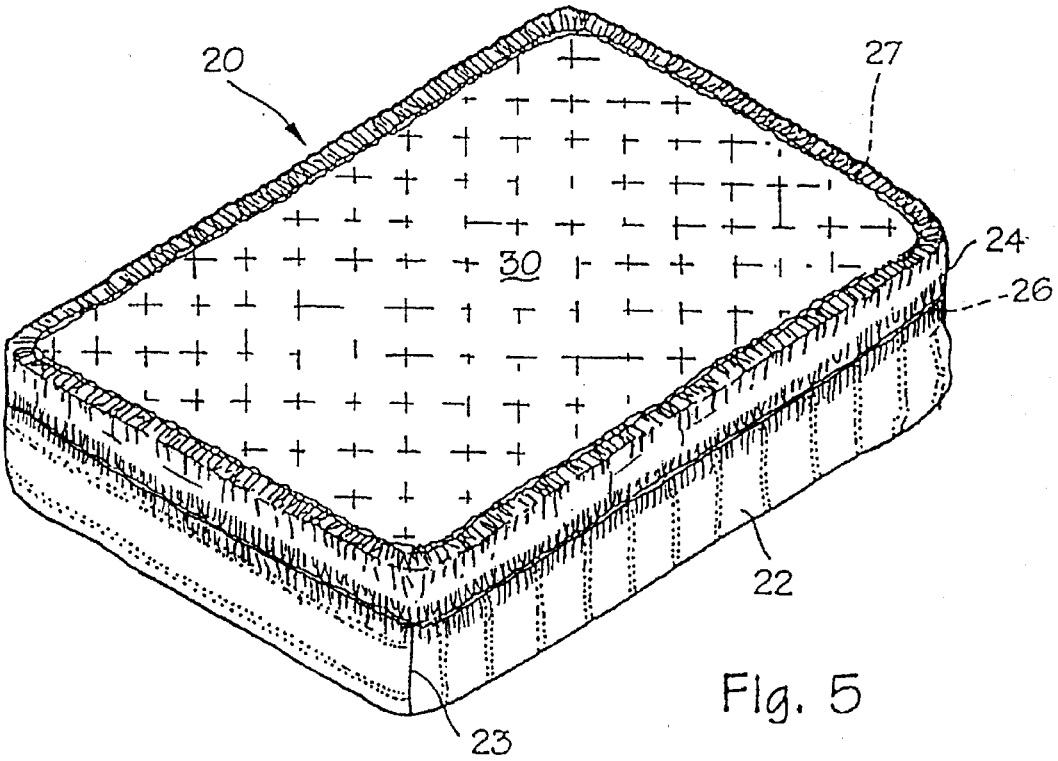
FIG. 5 is a perspective view of the mattress and covering of FIG. 4 as viewed looking toward the bottom of the mattress.

The same mattress pad 20, which is shown on an intermediate height mattress 29 in FIGS. 1, 2 and 3, is shown in FIGS. 4 and 5 fitted on a mattress 30 having a thickness (height) corresponding to the generally thickest portion (i.e., greatest height) of the standard range of heights for the mattress size for which the pad is adapted. Currently, this is about fourteen inches or more. In this installation, the side skirt 22 of pad 20 extends down to a location short of the bottom of the mattress sides and ends. The underskirt 24 extends downwardly, preferably covering the remainder of the mattress sides and ends and even continuing under the mattress 30 an extent sufficient to permit the innermost elastic cord 27 to draw the mattress pad 20 into fitted relation to the mattress 30 and to retain the pad 20 on the mattress 30. If the mattress is thicker (taller) than the combined heights of the sidewall 22 and underskirt 24, as may occur with the very thickest of current mattresses or with future, thicker mattresses, then both chords 26 and 27 of elastic material will grip the sides and ends of the mattress to retain the mattress pad 20 in position on the mattress.

Figure 6:
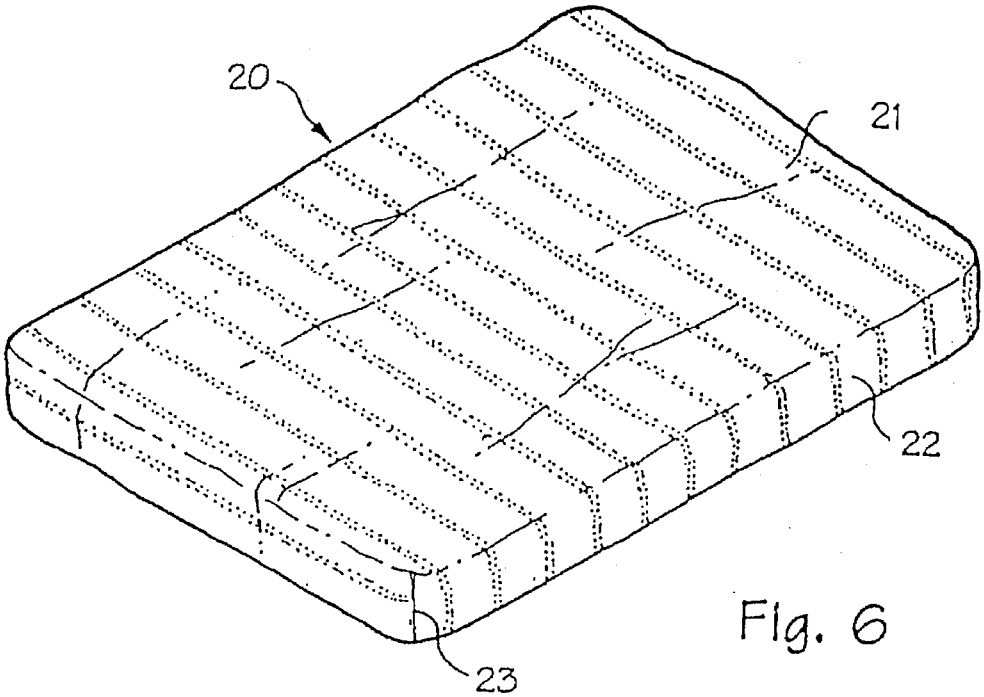
FIG. 6 is a perspective view of the mattress covering of FIG. 1 fitted on a mattress of a lower height than the mattress of FIG. 1.
Figure 7:
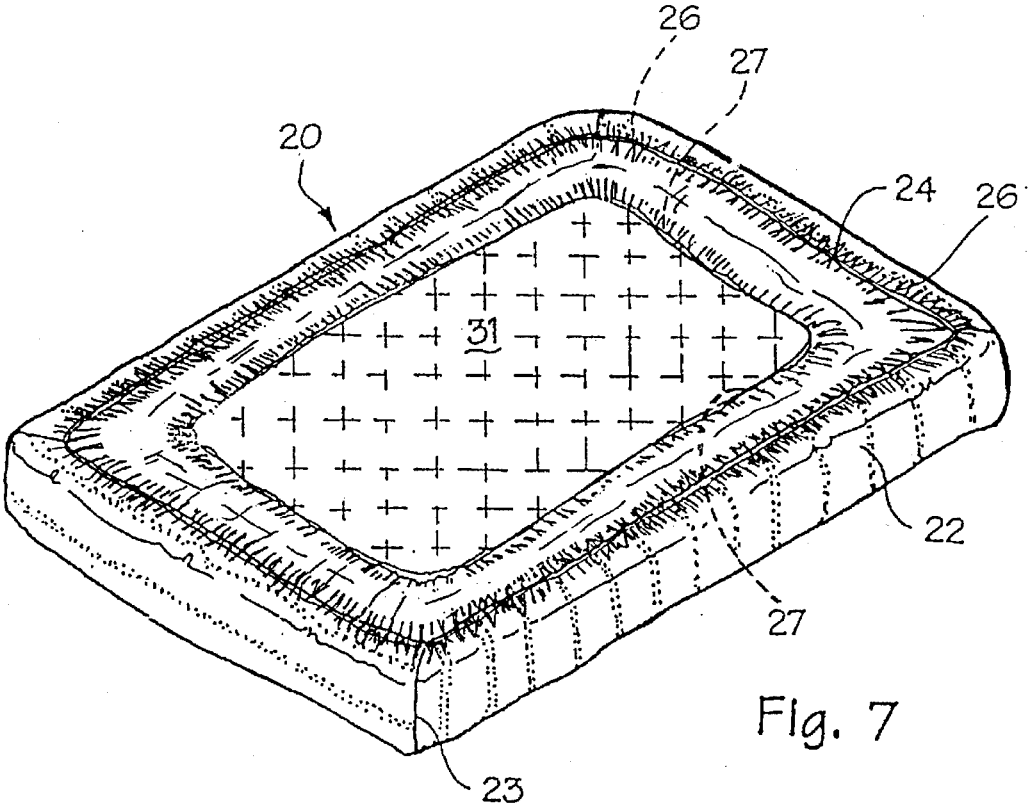
FIG. 7 is a perspective view of the mattress and covering of FIG. 6 as viewed looking toward the bottom of the mattress.

In FIGS. 6 and 7, the same mattress pad 20 is illustrated fitted on a mattress 31 of a thickness corresponding generally to the thinnest (lowest mattress height) portion of the standard range of heights for the mattress size on which the pad 20 is adapted to be used. In this installation, the side skirt 22 extends from the top panel portion 21 a distance greater than the height of the mattress 31 and, therefore, partially extends under the mattress 31, being drawn under by intermediate elastic chord 26 with the underskirt 24. Lowermost elastic chord 27 extends further under the mattress 31 to further draw the underskirt 24 deeper under the mattress 31 and the mattress pad 20 into a better fitted relation on the mattress 31.

Figure 8:
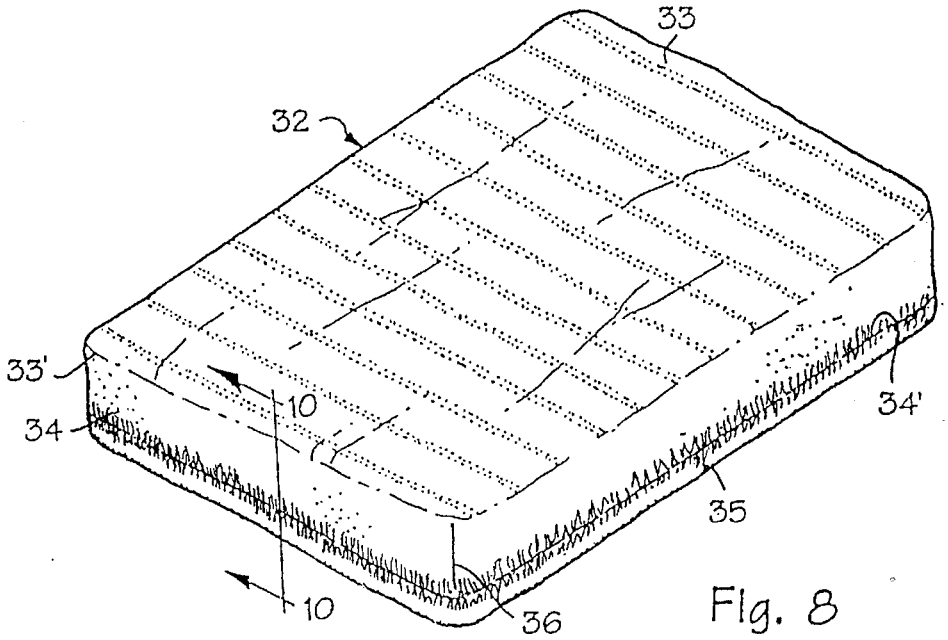
FIG. 8 is a perspective view of a mattress covering of another form of the preferred embodiment of the present invention fitted on a mattress.
Figure 10:
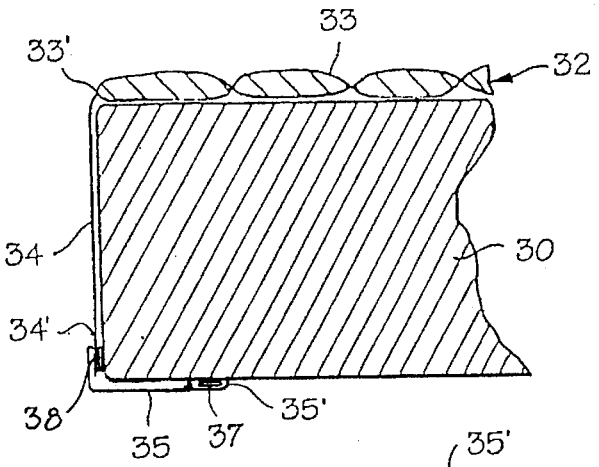
FIG. 10 is a partial vertical sectional view taken along line 10—10 of FIG. 8.
Figure 9:
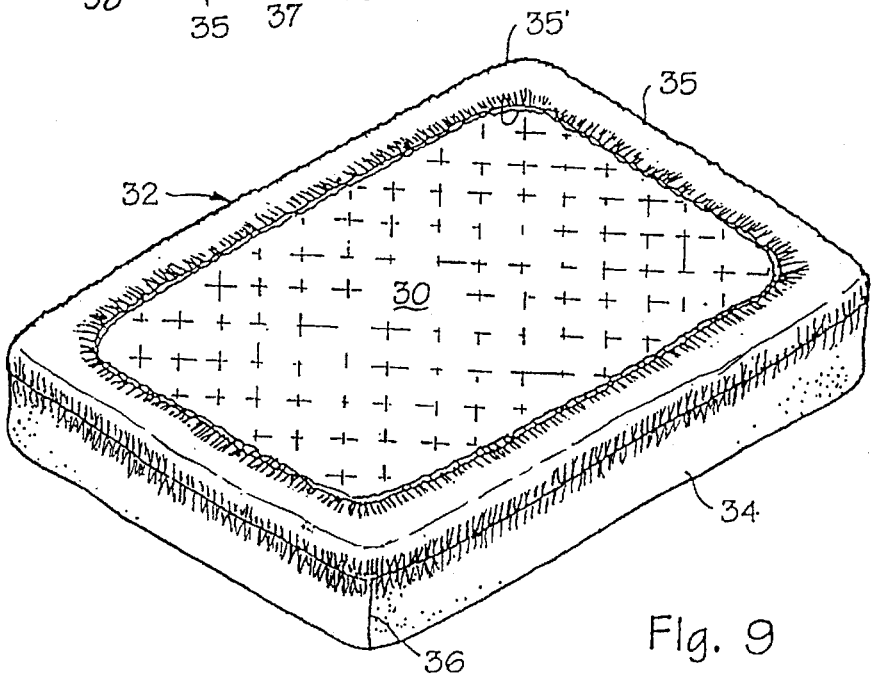
FIG. 9 is a perspective view of the mattress and covering of FIG. 8 as viewed looking toward the bottom of the mattress.

Another of the preferred embodiments of the present invention is depicted in FIGS. 8–10. Mattress pad 32 has the same type of quilted top portion 33 as the top portion 21 of mattress pad 20 of the previously described embodiment, but, instead of having a side skirt 22 formed of the same quilted material as the top portion, it has a separate inelastic side skirt 34 joined to the outer periphery 33' of top portion 33. Side skirt 34 is formed of a conventional inelastic sheet material having the same general dimensions as the side skirt 22 of the previously described embodiment. An inelastic panel underskirt 35 of the same type and dimensions as the inelastic panel underskirt 24 of the previously described embodiment 20, extends away from the periphery 34' of the side skirt 34 and the top portion 33. An elastic cord 37, like elastic cord 27, is secured with the outer periphery or free edge 35' of the underskirt 35 and a second elastic cord 38, like elastic cord 26, is secured between the outer periphery 33' of the top portion 33 and the outer periphery 35' of the inelastic underskirt 35, preferably at the seam at the side skirt periphery 34' between the side skirt 34 and the underskirt 35.

The side skirt 34 and the underskirt 35 of this embodiment 32 can be fabricated from separate pieces of different material such as a textile sheet material and a less expensive, less attractive material such as a nylon scrim, respectively. Each of the side skirt 34 and the underskirt 35 (or both) can be formed from separate pieces of material or by a single band of material which encircles the sides and ends of the mattress. Both constructions permit the use of a less expensive, single layer of material for side skirt 34 rather than a multi-layered quilted material of the previously described embodiment.

Figure 11:
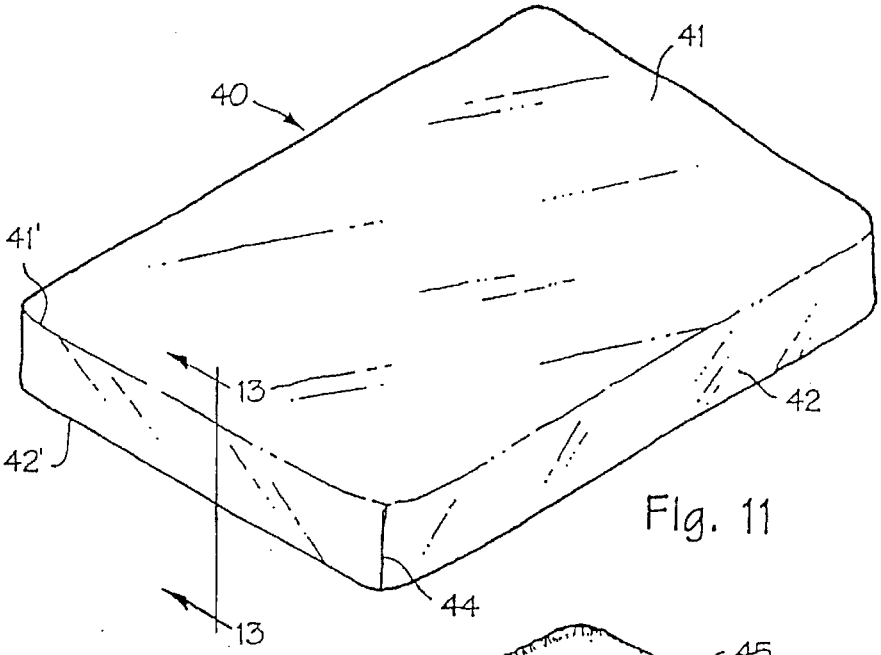
FIG. 11 is a perspective view of a mattress covering of a further form of the preferred embodiment of the present invention fitted on a mattress.
Figure 12:
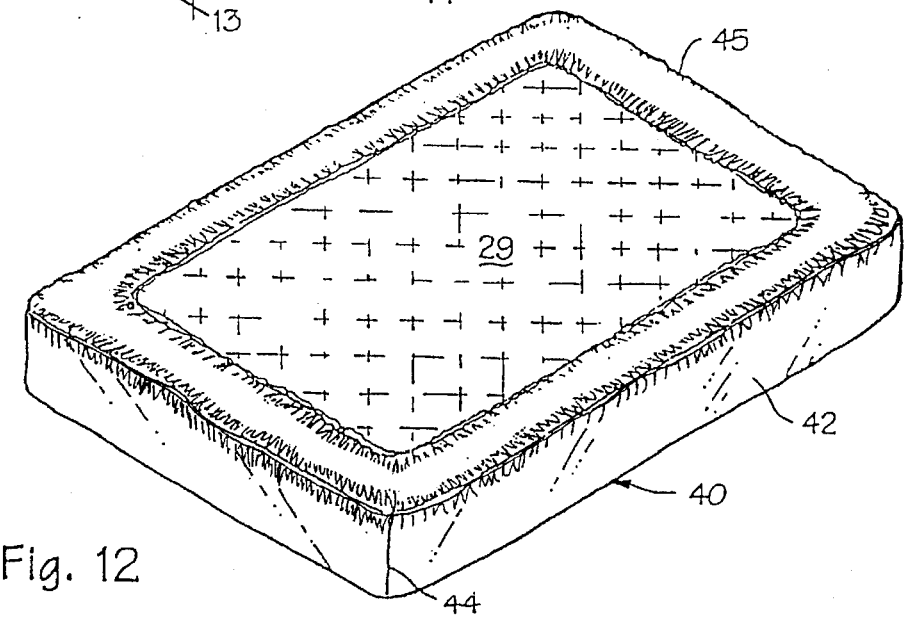
FIG. 12 is a perspective view of the mattress and covering of FIG. 11 as viewed looking toward the bottom of the mattress.
Figure 13:
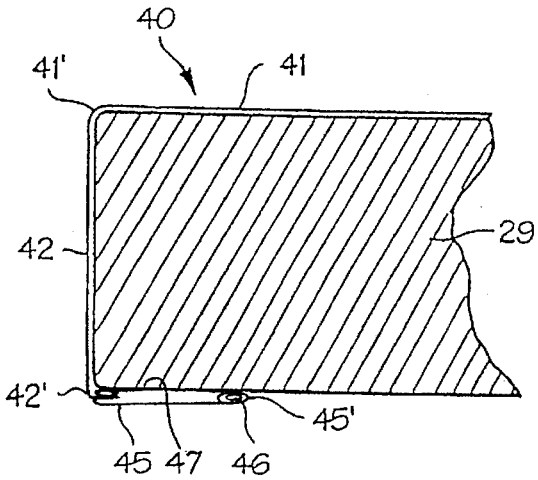
FIG. 13 is a partial vertical sectional view taken along line 13—13 of FIG. 11.

Mattress coverings of the present invention can also take the form of a fitted sheet as well as a mattress pad. The form of a preferred embodiment as a fitted sheet 40 is illustrated in FIGS. 11, 12 and 13. In this embodiment, the fitted sheet 40 has a top portion 41 with outer periphery 41' with dimensions generally the same as the predetermined dimensions of the top surface of a mattress of the size on which the sheet is to be used to at least substantially cover top surfaces of mattress of at least one predetermined standard top surface size. This top portion 41 is formed preferably of a single layer of a conventional, inelastic woven or unwoven textile sheet material. An inelastic side skirt 42 extends integrally from the outer periphery 41' of the top portion 41, preferably a distance generally the same as the height of mattress 29, which is from an intermediate height portion of a standard range of mattress heights, so as to provide a covering for at least substantially all of the sides and ends of the mattress 29. If corners 44 are seamed into the side skirt 42, they extend at least transversely and, preferably, generally perpendicularly and generally straight from the generally rectangular top portion 41. Extending away from and entirely around a periphery 42' of the side skirt 42, remote from the top portion 41, is an inelastic underskirt 45, which preferably is a panel of separate and different material, preferably less expensive material.

A first elastic cord 46 is secured with the underskirt outer periphery 45', remote from the side skirt 42. Cord 46 extends at least partially and preferably entirely around the periphery 45' of the underskirt 45, to facilitate retention of the sheet 40 in fitted disposition on any of the mattresses 29, 30, 31. A second elastic cord 47 is secured to the sheet 40 between the top portion outer periphery 41' and the underskirt periphery 45', preferably around the periphery 42' of the side skirt 42, where the material forming the side skirt 42 is joined to material forming the underskirt 45.

Figure 14:
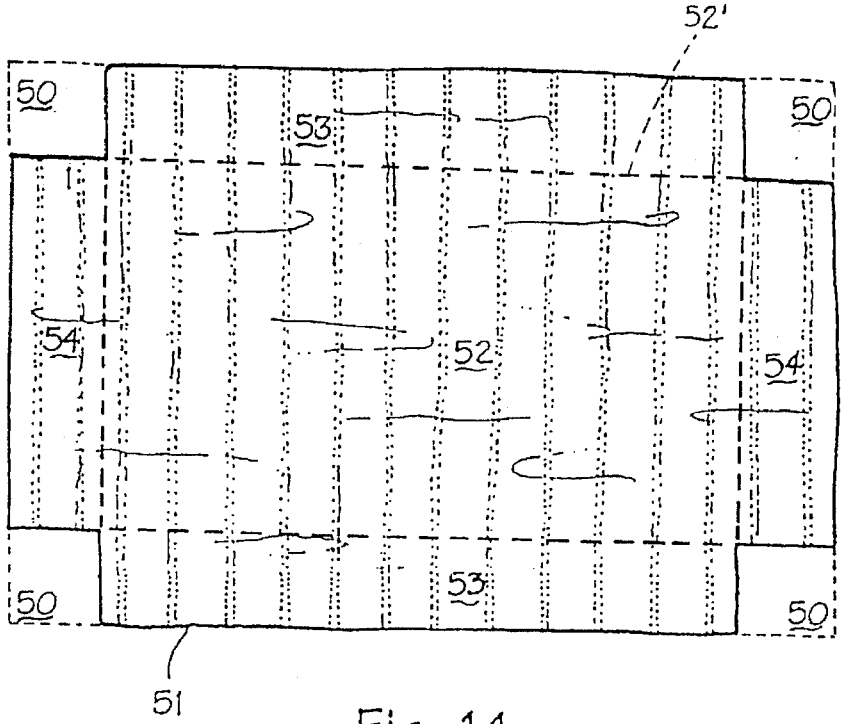
FIG. 14 is a plan view of a piece of material formed for use in providing the top portion and side skirt of a mattress covering.
Figure 15:
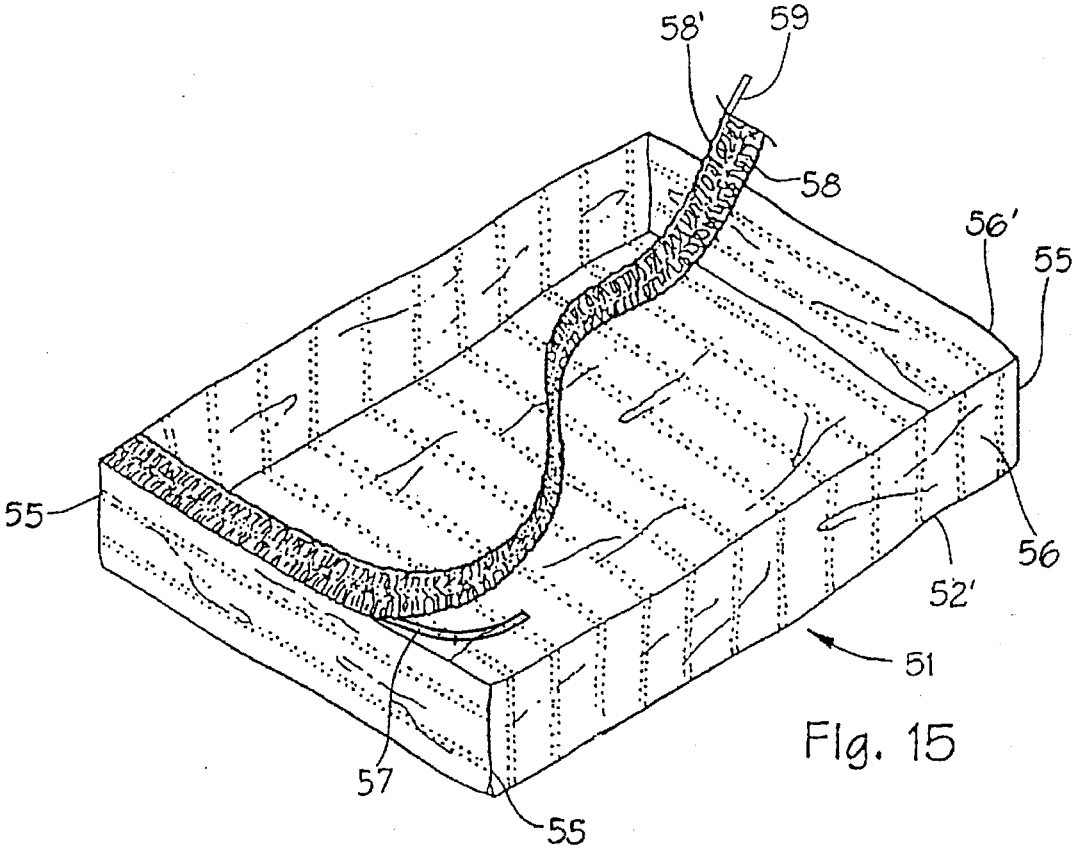
FIG. 15 is a perspective view of a partially manufactured mattress covering using the material of FIG. 14.

In making the mattress pad 20 or the fitted sheet 40, the top portion 21, 41 and side skirt 22, 24 can be formed from one piece of material 51 as shown in FIG. 14 by removing generally square portions from a rectangular piece of material 51 at the corners of the material 51 to form generally square recesses 50 at each corner of the material 51. This material 51 with recesses 50 in the corners can be a single piece of a multi-layer or a multi-ply quilted material for making the mattress pad 20 described above or a single layer of a conventional woven or non-woven textile fabric sheet material for making the fitted sheet 40 described above.

In making a mattress pad 32 having a side skirt 34 of material different from the material of the top portion 33 (which can also be done with fitted sheet construction), the side skirt 34 can be provided by sewing to a generally rectangular piece of material that forms the top portion, four rectangular panels of the skirt material so as to leave square recesses at the corners of the top portion in a configuration like that illustrated in FIG. 14. This approach is generally less desirable from aesthetic and cost considerations if the same material is used for the side skirt and top portion.

In FIG. 14, the top portion is indicated at 52, the two longer panels indicated at 53 and the two shorter panels at 54. If separate, panels 53, 54 are secured along outer periphery 52' of the top portion 52, which is indicated by a broken line. The panels 52, 53 are turned down vertically from the horizontal top portion 52 so that the edges of the panels forming each of the recesses abut each other. These edges are then sewn together to form the corners 55 preferably extending at least generally perpendicularly and straight from corners of the top portion 52.

Joined panels 53, 54 define the side skirt 56. Elastic cord 57 preferably is secured to the periphery 56' of the resulting side skirt 56 by being sewn to the periphery 56' while cord 57 is stretched, together with the panel of inelastic material 58 forming the underskirt. Alternatively the elastic cord 57 can be stretched through a fold or sleeve (not shown) formed at the periphery 56' and its free ends sewn together or to the side skirt 56 (or to the underskirt if subsequently added).

A separate elastic cord 59 is secured with the underskirt 58 at its outer periphery 58' remote from the top portion 52 and side skirt 56. Cord 59 may be secured directly to the underskirt 58 by suitable means such as stitching to or in a fold or sleeve formed in the underskirt 58 at the periphery 58'.

Preferably, the elastic cords 57 and 59 are secured to the material forming the underskirt 58 and/or side skirt 56 by conventional means, preferably sewing. Either or both cords 57 and 59 could be secured to the cover after the side skirt 56 and the underskirt 58 have been attached.

Figure 16:
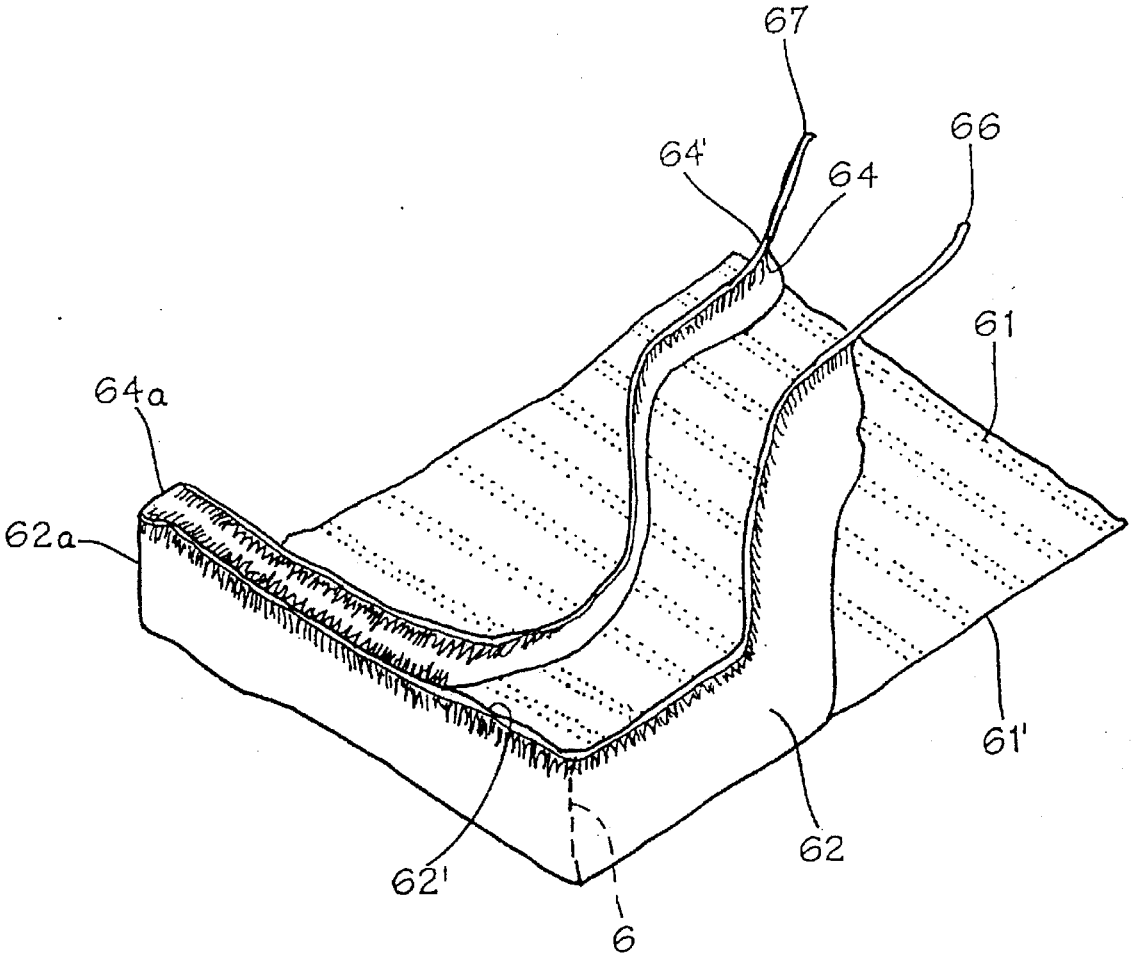
FIG. 16 is a perspective view of a partially manufactured mattress covering using a different method of construction.

FIG. 16 exhibits a slightly different possible construction. Two separate, continuous panels of inelastic material are joined together along common long edges to define a joined side skirt 62 and underskirt 64. The free long edge of the panel forming the side skirt 62 is attached to the outer periphery 61' of an inelastic, generally rectangular top portion 61, which is dimensioned to at least generally cover a top surface of mattresses of a predetermined standard top surface size. End **62*a* of the side skirt 62 and end 64*a* of the underskirt 64 are further similarly joined together with opposing ends (not depicted) of those panels in a conventional fashion, such as by stitching, preferably to form a corner extending generally straight and perpendicularly from a corner of the rectangular top portion 61. Alternatively, the inelastic panel forming underskirt 64 may be attached to the inelastic panel forming side skirt 62 after the side skirt panel has been attached to the top portion 61. Preferably at least two separate elastic cords 66 and 67 are secured with the skirt of the covering, cord 66 preferably with the side skirt 62 at its periphery 62' remote from the top panel portion 61 and cord 67 with the underskirt 64 at its remote periphery 64'. This could be done before or after each of the side skirt 62 and the underskirt 64 panels are attached to the top portion 61 of the covering 60** in the manner previously described.

Preferably all elastic cords 26, 27, 37, 38, 46, 47, 57, 59, 67 and 69 extend entirely around the perimeter of the mattress covering. However, it is recognized that one or more of the cords could be extended around only a portion of the covering perimeter or may be provided by several separate portions which collectively extend only part way around the covering perimeter to save costs, to attempt to avoid patent infringement and possibly other reasons. All such constructions are intended to be covered by the present invention.

The side skirt can be joined with the top portion and the underskirt joined with the side skirt, where the separate material pieces are used, in a conventional fashion such as stitching with inelastic (or elastic) threads. If the fabrics are polymers, it may be possible to join them with adhesives or by ultrasonic bonding.

The elastic cords can be sewn directly to inelastic fabric in a conventional fashion by stretching them to their full length or essentially their full length while sewing them to the inelastic fabric with inelastic thread. The elastic cords can also be secured with the skirt material by locating the cord in a fold or sleeve formed from the skirt material. If the cords are an elastomer, the cords may also be bonded with the skirt material. For example, the cords could be stretched and spot bonded with the skirt material. Depending upon the material of the skirt and the elastic cord, the bonding means may be adhesive or a direct ultrasonic or thermal bonding between the elastic cord or skirt material.

Elastic cords as referred to in this application are items which are much heavier than elastic thread and too large to be passed through needles of existing sewing machines in order to be stitched themselves into the skirt material as thread. These elastic cords may be lengths of raw or covered rubber, may be flat or round in cross section and if round, may be formed by several smaller individual rubber strips which are bound together in a cover. The cords also may be lengths of knitted elastic thread, which after knitting, is no longer capable of being passed through a sewing machine. Because they cannot be stitched directly into fabric themselves, some other means must be provided to secure them with the skirt material.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred and other embodiments, it is to be understood that this disclosure is only illustrative and exemplary of the present invention and is made merely for purposes of provided in a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A matress covering adapted for fitted disposition over the top, sides, ends and corners of mattresses of standard top surface sizes comprising:

an inelastic, genrally rectangular rod portion having outer periphery dimensioned to at least substantially cover the top surface of mattresses of at least one predetermined standard top surface size;

an inelastic side skirt extending transversely from the outer periphery of the generally rectangular top portion around the entire outer periphery of the top portion;

an inelastic panel extending away from a periphery of the side skirt remote from the top portion and entirely around the side skirt periphery;

a first elastic cord;

means for securing the first elastic cord to the inelastic panel at a periphery of the panel remote from the side skirt;

a second elastic cord;

means for securing the second elastic cord with one of the side skirt and the inelastic panel at a location between the outer periphery of the top portion and the periphery of the inelastic panel.

2. The mattress covering of claim 1 wherein the second elastic cord is located at the side skirt periphery.

3. The mattress covering of claim 1 wherein the first and second elastic cords extend generally in a longitudinal dimension of the inelastic panel and the side skirt.

4. The mattress covering of claim 1 wherein the first and second elastic cords parallel the periphery of the inelastic panel and the side skirt, respectively.

5. The mattress covering of claim 1 wherein the first and second elastic cords extend generally parallel to the outer periphery of the top portion.

6. The mattress covering of claim 1 wherein the second cord extends entirely around the side skirt.

7. The mattress cover of claim 1 wherein the first and second cords extend at least essentially entirely around the inelastic panel and side skirt, respectively.

8. The mattress covering of claim 1 wherein said top portion and said side skirt are formed in one piece from the same material.

9. The mattress covering of claim 8 being a mattress pad and wherein the same material forming the top portion and the side skirt is quilted.

10. The mattress covering of claim 8 being a fitted sheet and wherein a single layer of textile sheet material forms the top portion and the side skirt.

11. The mattress covering of claim 1 wherein the side skirt has a width dimension between the outer periphery of the top portion and the outer periphery of the side skirt at least as great as a width dimension of the inelastic panel between the outer periphery of the side skirt and the outer periphery of the panel.

12. The mattress covering of claim 11 wherein the width dimension of the side skirt is between about one and four times the width dimension of the inelastic panel.

13. The mattress covering of claim 11 wherein said side skirt width dimension is at least four inches.

* * * * *